United States Patent [19]

Shamass

[11] Patent Number: 4,913,365

[45] Date of Patent: Apr. 3, 1990

[54] DISPENSER FOR ROLLED SHEET MATERIALS

[76] Inventor: John M. Shamass, 13845 Adams Dr., Warren, Mich. 48093

[21] Appl. No.: 878,348

[22] Filed: Jun. 25, 1986

[51] Int. Cl.[4] ..... B65H 75/18

[52] U.S. Cl. ..... 242/55.2

[58] Field of Search ..... 242/55.2, 68.4, 129.6, 242/129.62, 55.3, 55.53; 248/207, 266, 267

[56] References Cited

U.S. PATENT DOCUMENTS

| | | | |
|---|---|---|---|
| D. 91,282 | 1/1934 | Reynolds . | |
| D. 166,439 | 4/1952 | Badami . | |
| D. 217,187 | 4/1970 | Andis . | |
| 438,770 | 10/1890 | Whilden . | |
| 503,277 | 8/1893 | Brigham | 242/129.6 |
| 507,124 | 10/1893 | Haynes et al. | 242/129.6 |
| 811,874 | 2/1906 | Ruff | 248/267 |
| 1,029,761 | 6/1912 | Marx | 242/129.62 |
| 1,101,324 | 6/1914 | Parker | 248/267 |
| 1,432,194 | 10/1922 | Liddell | 242/55.2 |
| 1,437,157 | 11/1922 | Simcox et al. | 242/55.2 |
| 1,955,489 | 4/1934 | Duncan et al. | 242/68.4 |
| 2,244,804 | 6/1941 | Robinson | 242/55.2 |
| 2,369,970 | 2/1945 | McClearen | 242/55.2 |
| 2,801,131 | 7/1957 | Gauthier | 242/55.2 X |
| 3,943,859 | 3/1976 | Boone | 242/55.2 X |
| 3,999,350 | 12/1976 | MacKenzie | 52/633 |
| 4,014,426 | 3/1977 | Neufeld | 242/68.4 X |
| 4,071,200 | 1/1978 | Stone | 242/55.2 |
| 4,483,491 | 11/1984 | Rainey | 242/55.2 |

FOREIGN PATENT DOCUMENTS

| | | | |
|---|---|---|---|
| 47804 | 9/1933 | Denmark | 242/55.2 |

*Primary Examiner*—Katherine A. Matecki
*Attorney, Agent, or Firm*—Peter D. Keefe

[57] ABSTRACT

A dispenser for roll sheet material operable for various attachment orientations. A frame is provided having a base and two projection members at either end. The projections each contain a slot and a triplicated spindle support, permitting the user to orient the frame in any of three ways with the roll handling spindle at all times properly seated.

4 Claims, 1 Drawing Sheet

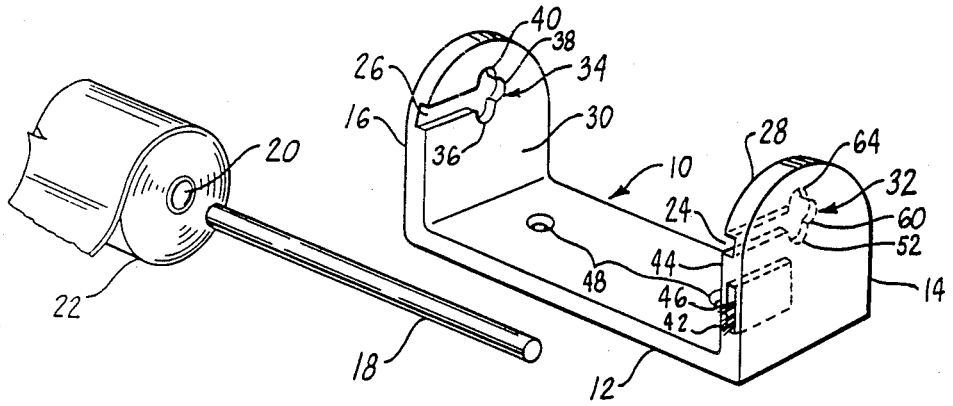
FIG-1
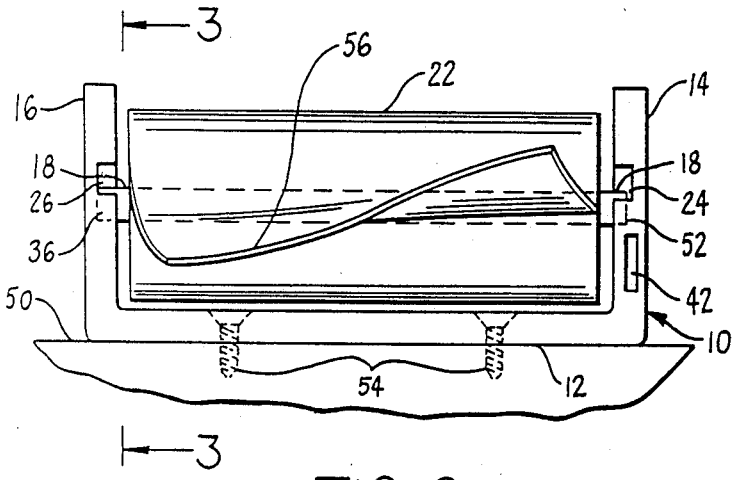
FIG-2
FIG-3
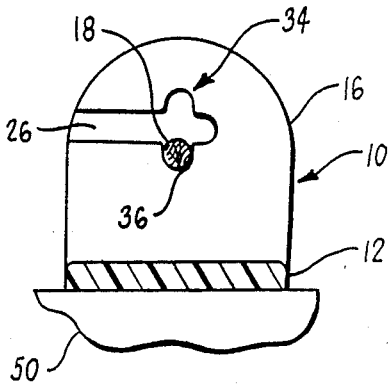
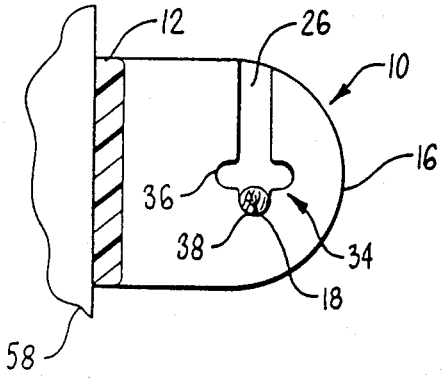
FIG-4
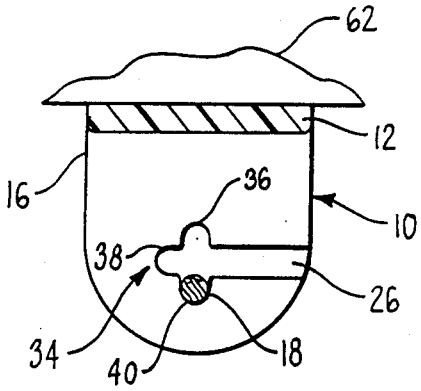
FIG-5

DISPENSER FOR ROLLED SHEET MATERIALS

BACKGROUND OF THE INVENTION

This invention relates to dispensers for rolled sheet materials, more particularly to dispensers which utilize a removable axial spindle.

Devices for holding and dispensing rolled sheet materials, such as paper, commonly utilize a spindle which is intended to be placed within an axial cavity of the roll, permitting the roll to be rotated and material dispensed. An example of this in U.S. Pat. No. 4,483,491 to Rainey, where a removable spindle is utilized to hold rolled paper toweling on each side of a "U" shaped frame.

In use, there are frequent occasions where it is most desirable to locate a dispenser in an enclosed space, such as a closet. In such a case, there is a need to be able to attach the frame of the dispenser in a variety of ways: on a horizontal surface, from an overhead surface, or directly to a wall. Consequently, there exists the need in the art to provide an attachment means for the spindle that will accommodate a variety of attachment orientations for the dispenser, while at the same time providing easy access to the spindle in installation situations where space is very limited.

It is, therefore, an object of the invention to provide a rolled sheet material dispenser having a spindle attachment means which permits a number of predetermined mounting attitudes for the frame.

It is a further object of the invention to provide a rolled sheet material dispenser which may be mounted in a confined narrow space, such as a closet, without affecting its efficiency of operation.

These, and additional objects, advantages, features, and benefits of the invention will become apparent from the following specification.

SUMMARY OF THE INVENTION

In the present invention, a dispenser is provided for rolled sheet material, such as rolled paper towels or garbage bags. The invention generally comprises a frame of "U" shape, comprising a base and two projecting members, and a spindle. The projection members have a slot on their inside surface, running parallel to the base, which terminates centrally in a triplicated spindle support.

In operation, the user inserts the spindle into the axial cavity of the roll, then inserts the spindle into the frame slots until the spindle drops into one of the provisions of each of the triplicated spindle supports by action of gravity. The sheet material can then be dispensed by tugging on its exposed end.

BRIEF DESCRIPTION OF THE DRAWINGS

FIG. 1 is an exploded perspective view of the invention.

FIG. 2 is a plan view of the invention in operation.

FIG. 3 is a side view of the invention, along lines 3—3 in FIG. 2, mounted on a horizontal surface.

FIG. 4 is a side view as in FIG. 3, mounted to a vertical surface.

FIG. 5 is a side view as in FIG. 3, mountably depending from a horizontal surface.

DETAILED DESCRIPTION OF THE PREFERRED EMBODIMENT

Referring now to FIG. 1, a "U" shaped frame 10 is provided having a base 12 and two projecting members 14 and 16 which are at a ninety degree disposition thereto. A spindle 18 is adapted to insert into the standard axial cavity 20 of a roll of sheet material 22. Each of the projection members 14 and 16 is provided with a slot 24 and 26 located on the inside surfaces 28 and 30 thereof, respectively. The slot runs parallel to the base 12 and terminates substantially mid-way the width of the projection member in a triplicated spindle support 32 on side 28 and 34 on side 30. The triplicated spindle support is composed of three separate semi-circular cut-outs in non-overlapping relation 36, 38 and 40 on side 30, side 28 having a similar arrangement, shown in outline, having the same depth of cut as the slot. Each semi-circular cut-out of triplicated spindle support 34 has a radius of curvature substantially equal in length to one-half the width of the slot 26 and they are mutually arranged such that slot 26 ends in a semi-circular cut-out 38 that concavely faces the slot 26, and adjacent to cut-out 38 is located cut-outs 36 and 40 each concavely facing the slot 26 and each other and each oriented in perpendicular relation to cut-out 38; the slot and the cut-outs have a depth forming in combination a guide for the spindle 18 so that when it is inserted between the projection members 14 and 16 it is guided by the slot on each projection member until it drops by action of gravity into one of the three semi-circular cut-outs of each triplicated spindle support. A continuous shallow notched area is thereby formed on the inside surface of the projection members by the combination of the slot and the triplicated spindle support. Further, each slot, as well as its associated triplicated spindle support is sized to accept an object substantially the diameter of the spindle. The separation of the projection members 14 and 30 is such as to accept a commercially standard size roll of sheet material, and the distance between the base and the slot on each projection member is calculated also for such an accommodation. The spindle is slightly longer than the length of the roll of sheet material 22 and the slots 24 and 26 are adapted to accept insertion of the spindle, as are the triplicated spindle supports. A cavity 42 is provided in the forward facing side of one of the projection members 44 for the storage of plastic bag ties 46. Beveled apertures 48 are provided in the base for screw or bolt connection of the frame 10 to an attachment surface, shown in FIG. 2.

FIG. 2 shows the invention in operation with a sheet material roll 22 on the spindle 18. From the figure, it will be seen that the frame 10 is oriented for attachment to a horizontal surface 50 and the spindle has accordingly rested by action of gravity into semi-circular cut-out 36 of triplicated spindle support 34 on side 30 of projection member 16 and its corresponding semi-circulr cut-out 52 in triplicated spindle support 32 on side 28 of projection member 14. In the preferred embodiment, wood screws 54 are utilized, in cooperation with apertures 48 to attach the frame 10 at the base 12 to a surface 50. Rolled sheet material 22 may be dispensed by tugging on its exposed end 56, causing a rotary action of the roll on the spindle, or the roll and the spindle, with consequent dispensement of the sheet material.

FIGS. 3–5 show the operable orientations for the frame in relation to an attachment surface, along lines 3—3 in FIG. 2, showing particularly side 30 of projection member 16. FIG. 3 shows the frame 10 attached at the base 12 atop a horizontal surface 50, such as a table top or a shelf. The spindle 18 is shown resting in the triplicated spindle support 34 in semi-circular slot 36.

As well, it is resting in the corresponding semi-circular cut-out 52, in triplicated spindle support 32. In FIG. 4, the frame 10 is connected to a vertical surface 58, such as a wall. The spindle 18 is shown resting in the triplicated spindle support 34 in semi-circular cut-out 38. As well, it is resting in the corresponding semi-circular cut-out 60, in triplicated spindle support 32. In FIG. 5, the frame 10 is connected dependingly from an overhead horizontal surface 62, such as a ceiling or underside of a shelf. The spindle 18 is resting in the triplicated spindle support 34 in semi-circular cut-out 40. As well, it is resting in the corresponding semi-circular cut-out 6, in triplicated spindle support 32. In each of the three attitudes of attachment shown in FIGS. 3–5, the spindle rests in the indicated triplicated spindle support semi-circular cut-out under the action of gravity, and it is free to rotate.

It will be seen, therefore, from the foregoing discussion of the preferred embodiment, that the invention can be placed in installation situations where width space is at a minimum, such as in a closet. Because the spindle inserts forwardly into the frame, and is of less length than the distance between the outer surfaces of the projection members, a closet or other confined space having a width of the invention is not a bar to operation.

In the preferred embodiment, the frame is made of plastic and the spindle is made of wooden dowling. Equally, the invention may be made entirely of metal, plastic or wood, or a combination thereof.

In operation, the user inserts the spindle 18 into the axial cavity 20 of a roll of sheet material 22. He then inserts the spindle simultaneously into each of the slots 24 and 26 in the projection members 14 and 16 until the spindle drops into one of the triplicated spindle support 32 and 34 semi-circular cut-outs, 52 and 36 in FIG. 2, under the action of gravity. Material may then be dispensed by pulling on the exposed end 56 of the sheet material, causing a rotary action of the roll and consequent dispensement of material. Removal of the spindle is accomplished by lifting the spindle out of the said semi-circular cut-outs, then pulling the spindle directly out of the frame along the slots.

To those skilled in the art to which this invention pertains, the above described preferred embodiment may be subject to change or modification. Such changes or modifications can be carried out without departing from the scope of the invention, which is intended to be limited only by the scope of the appended claims.

I claim:

1. A dispenser for sheet material rolled about an axis, said material having a spindle axially disposed along said axis exceeding in length said sheet material along said axis, comprising:

a base having a first and a second end;

a pair of projection members mounted to said base, one each at each said end of said base, each of said projection members being disposed at a ninety degree angle in relation to said base and in parallel relation to each other so that each of said projection members has a mutually facing side and each of said projection members in combination with said base form a "U" shape, each of said projection members further having on each said mutually facing side a slot running mutually substantially parallel and equidistant for guiding, without need of force except as may be required to overcome friction, insertion of said spindle between said projection members, said slot on each of said projection members terminating in a triplicated spindle support for retaining said spindle in a fixed relation to said base in any one of three predetermined orientations of said base, said triplicated spindle support on each said projection member having a first, a second and a third separate semi-circular shaped cut-out in non-overlapping relation to each other, each said separate semi-circular shaped cut-out having a radius of curvature substantially equal in length to one-half of said slot width, said slot ending in said first semi-circular shaped cut-out, said first semi-circular shaped cut-out concavely facing said slot, said second and said third semi-circular shaped cut outs being located adjacent said first semi-circular shaped cut-out, said second and third semi-circular shaped cut-outs concavely facing each other and said slot, said first, second and third semi-circular shaped cut-outs having a depth of cut forming in combination with said slot a guide for said spindle when said spindle is inserted between said projection members so that said spindle may be guided by said slot on each of said projection members until said spindle drops by action of gravity into one of said first, second and third semi-circular shaped cut-outs on each of said projection members.

2. The dispenser of claim 1, wherein said three predetermined orientations of said base are determined by a first direction defined by projection of said projection members from said base relative to a second direction defined by gravitational pull, said orientations comprising a first orientation in which said first direction is parallel to said second direction, a second orientation in which said first direction is perpendicular to said second direction and a third orientation in which said first direction is opposite to said second direction.

3. A dispenser for sheet material rolled about an axis, said material having an axial cavity along said axis, comprising a base having a first and a second end;

a spindle having an axial length exceeding that of said material along said axis, for axial mounting of said material thereon by insertion into said axial cavity;

a pair of projection members mounted to said base, one each at each said end of said base, each of said projection members being disposed at a ninety degree angle in relation to said base and in parallel relation to each other, said projecton members further having mutually facing sides;

means for guiding, without need of force except to overcome friction, insertion of said spindle between said projection members; and means for retaining said spindle in a fixed relation to said base in any one of three predetermined orientations of said base;

said guiding means and said retaining means comprising a slot on each said mutually facing side of said projection members, said slot running mutually substantially parallel and equidistant for guiding, without need of force except as may be required to overcome friction, insertion of said spindle between said projection members, said slot on each of said projection members terminating in a triplicated spindle support for retaining said said spindle in any one of three predetermined orientations of said base, said triplicated spindle support having a first, a second and a third separate semi-circular shaped cut-out in non-overlapping relation to each other, each said separate semi-circular shaped cut-out having a radius of curvature substantially equal in length to one-half of said slot width, said slot ending in said first semi-circular shaped cut-out, said first semi-circular shaped cut-out concavely facing said slot, said second and said third semi-circular shaped cut outs being located adjacent said first semi-circular shaped cut-out, said second and third semi-circular shaped cut-outs concavely facing each other and said slot, said first, second and third semi-circular shaped cut-outs having a depth of cut forming in combination with said slot a guide for said spindle when said spindle is inserted between said projection members so that said spindle may be guided by said slot on each of said projection members until said spindle drops by action of gravity into one of said first, second and third semi-circular shaped cut-outs on each of said projection members.

4. The dispenser of claim 3, wherein said three predetermined orientations of said base are determined by a first direction defined by projection of said projection members from said base relative to a second direction defined by gravitational pull, said orientations comprising a first orientation in which said first direction is parallel to said second direction, a second orientation in which said first direction is perpendicular to said second direction and a third orientation in which said first direction is opposite to said second direction.

* * * * *